US006634590B1

(12) United States Patent
Rau et al.

(10) Patent No.: US 6,634,590 B1
(45) Date of Patent: Oct. 21, 2003

(54) FILLING WIND FOR BOBBIN TWISTING

(75) Inventors: Robert B. Rau, Greensboro, NC (US); John B. Shoemaker, Lexington, NC (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 09/693,472

(22) Filed: Oct. 20, 2000

(51) Int. Cl.[7] ..... B65H 54/28
(52) U.S. Cl. ..... 242/479; 242/479.8; 242/920
(58) Field of Search ..... 242/478.6–479.1, 242/479.6, 479.8, 920

(56) References Cited

U.S. PATENT DOCUMENTS

| | | | | | |
|---|---|---|---|---|---|
| 726,570 | A | * | 4/1903 | Purcell | 242/479.1 |
| 1,013,846 | A | * | 1/1912 | Rhoades | 242/479 |
| 1,119,530 | A | * | 12/1914 | Owen | 242/478.8 |
| 1,367,670 | A | * | 2/1921 | Rhoades | 242/478.8 |
| 2,221,999 | A | * | 11/1940 | Reiners et al. | 242/479.6 |
| 2,326,307 | A | * | 8/1943 | Peterson | 242/479.6 |

(List continued on next page.)

FOREIGN PATENT DOCUMENTS

| | | |
|---|---|---|
| DE | 198 36 861 | 2/2000 |
| JP | 02 277827 | 11/1990 |
| JP | 06 287820 | 10/1994 |

OTHER PUBLICATIONS

"The Manufacturing Technology of Continuous Glass Fibres" by K. L. Loewenstein, 3rd Ed. 1993, pp. 30–44.
"The Manufacturing Technology of Continuous Glass Fibres" by K. L. Loewenstein, 3rd Ed. 1993, pp. 47–103.
"The Manufacturing Technology of Continuous Glass Fibres" by K. L. Loewenstein, 3rd Ed. 1993, pp. 115–165.
"The Manufacturing Technology of Continuous Glass Fibres" by K. L. Loewenstein, 3rd Ed. 1993, pp. 238–295.
Encyclopedia of Polymer Science and Technology, vol. 6, 1967, pp. 505–712.
IPC The Institute for Interconnecting and Packaging Electronic Circuits entitled "IPC–EG 140 'Specification for Finished Fabric Woven from "E" Glass for Printed Boards'", Jun. 1997, p. 1.
"The Manufacturing Technology of Continuous Glass Fibres" by K. L. Loewenstein, 3rd Ed. 1993, pp. 169–177.
"The Manufacturing Technology of Continuous Glass Fibres" by K. L. Loewenstein, 3rd Ed. 1993, pp. 224–230.
"The Manufacturing Technology of Continuous Glass Fibres" by K. L. Loewenstein, 3rd Ed. 1993, p. 322, 333–339.
U.S. patent application Ser. No. 09/620,526 entitled "Impregnating Glass Fiber Strands and Products Including the Same" filed Jul. 20, 2000 by Bruce E. Novich et al.

*Primary Examiner*—Michael R. Mansen
(74) *Attorney, Agent, or Firm*—Andrew C. Siminerio

(57) ABSTRACT

A method of forming a wound fiber package comprises winding a first portion of strand having at least one fiber on a bobbin using a first indexing ratio A:B, wherein A is greater than 0 and A is greater than B, and winding a second portion of strand having at least one fiber on the bobbin using a second indexing ratio A:B different from the first indexing ratio, wherein A and B are greater than 0. In one non-limiting embodiment of the invention, B equals 0 in the first indexing ratio, A in the first indexing ratio equals A in the second indexing ratio, and A equals B in the second indexing ratio. In another non-limiting embodiment of the invention, B is greater than 0 in the first indexing ratio, A in the first indexing ratio equals A in the second indexing ratio, and A equals B in the second indexing ratio. This method may be used to produce a wound package.

36 Claims, 3 Drawing Sheets

U.S. PATENT DOCUMENTS

| | | | | | |
|---|---|---|---|---|---|
| 2,841,949 | A | * | 7/1958 | Leutert | 242/479.1 |
| 3,246,855 | A | * | 4/1966 | Preston | 242/920 |
| 3,685,764 | A | | 8/1972 | Drummond | |
| 3,741,489 | A | * | 6/1973 | Kawamura et al. | 242/479.6 |
| 3,860,194 | A | | 1/1975 | Roscher | |
| 3,998,326 | A | | 12/1976 | McKee, Jr. | |
| 4,316,357 | A | * | 2/1982 | Le Chatelier | 242/478.6 |
| 4,390,647 | A | | 6/1983 | Girgis | |
| 4,542,106 | A | | 9/1985 | Sproull | |
| D282,312 | S | | 1/1986 | Dick | |
| 4,596,366 | A | | 6/1986 | Dick et al. | |
| 4,600,165 | A | | 7/1986 | Shoemaker | |
| D292,643 | S | | 11/1987 | Dick et al. | |
| 4,795,678 | A | | 1/1989 | Girgis | |
| 5,255,863 | A | * | 10/1993 | Horndler | 242/920 |
| 5,725,167 | A | | 3/1998 | Garwood et al. | |
| 5,789,329 | A | | 8/1998 | Eastes et al. | |

* cited by examiner

FILLING WIND FOR BOBBIN TWISTING

BACKGROUND OF THE INVENTION

1. Field of the Invention

The present invention relates to a winding configuration for yarn on a bobbin for use in a weaving operation to reduce bobbin pay-out failures due to yarn-on-yarn abrasion and reduce handling.

2. Technical Considerations

Glass fibers are commonly formed by attenuating molten glass through orifices in a bushing. The fibers are then drawn across an applicator which coats at least a portion of the fiber surface with a sizing composition, gathered into one or more discrete strands by gathering shoes, and wound on a winding machine into a forming package. The forming packages are then collected and typically placed in a drier to dry the sizing composition. After drying, the forming packages are moved to a twist frame where the fiber strands are unwound from the forming package and wound onto a bobbin. The bobbins are thereafter used to form warp beams and supply weft, or fill, yarn during a weaving operation.

In a typical glass fiber yarn weaving operation, the warp yarn is supplied by a loom beam which includes from several hundred to several thousand glass fiber strands. To form the loom beam, bobbins having the warp yarn are positioned in a creel and the yarn strands are threaded through guides and wound around a section beam. Several section beams, typically 2 to 8 section beams, are then combined, e.g. by a rebeaming or slashing operation, to form a loom beam. Traditionally, the glass fiber warp yarn is wound on the bobbins in a "pirn" or "bottle" shape or build. In a pirn build, the wound package on the bobbin includes a generally cylindrically shaped central portion and tapered end portions. In a bottle build, the wound package on the bobbin includes a generally cylindrically shaped lower portion and a tapered upper portion. Both of these builds are formed by traversing the twist ring rail of a twist frame over all parts of the bobbin in a cycle that is completed approximately every twenty minutes and repeated until the bobbin is filled, i.e. until the desired bobbin weight is achieved.

As the warp yarn is removed from the bobbin (sometimes referred to herein as "pay-out") to form the loom beam, the yarn can be dragged along the underlying layer of yarn. This yarn-on-yarn abrasion can cause broken filaments and yarn breakage It would be advantageous to provide a yarn package on a bobbin that reduces this breakage and accompanying broken filament and yarn while maximizing the amount of yarn on the bobbin.

SUMMARY OF THE INVENTION

The present invention provides a method of forming a wound fiber package, comprising: winding a first portion of strand comprising at least one fiber on a bobbin using a first indexing ratio A:B, wherein A is greater than 0 and A is greater than B; and winding a second portion of strand comprising at least one fiber on the bobbin using a second indexing ratio A:B different from the first indexing ratio, wherein A and B are greater than 0. In one non-limiting embodiment of the invention, B equals 0 in the first indexing ratio, A in the first indexing ratio equals A in the second indexing ratio and A equals B in the second indexing ratio. In another non-limiting embodiment of the invention, B is greater than 0 in the first indexing ratio, A in the first indexing ratio equals A in the second indexing ratio and A equals B in the second indexing ratio.

The present invention also provides a method of forming a wound fiber package, comprising: forming an initial section of strands comprising at least one fiber, the initial section having a conical shaped surface and a desired package diameter; and winding a plurality of successive strand layers over the conical shaped surface while maintaining the desired package diameter so as to form a wound fiber package comprising a cylindrical portion and a conical shaped portion at one end of the cylindrical portion.

The present invention further provides a method of forming a wound glass fiber package, comprising: winding a strand comprising at least one glass fiber on a bobbin using an indexing ratio A:B, wherein A is greater than 0, so as to form a wound package comprising at least a conical shaped portion.

Another aspect of the present invention is a wound fiber package, comprising: a first portion of strand comprising at least one fiber on a bobbin having a first indexing ratio A:B, wherein A is greater than 0 and A is greater than B; and a second portion of strand comprising at least one fiber on the bobbin having a second indexing ratio A:B different from the first indexing ratio, wherein A and B are greater than 0. In one non-limiting embodiment of the invention, B equals in the first indexing ratio, B equals 0, A in the first indexing ratio equals A in the second indexing ratio and A equals B in the second indexing ratio. In another non-limiting embodiment of the invention, B is greater than 0 in the first indexing ratio, A in the first indexing ratio equals A in the second indexing ratio and A equals B in the second indexing ratio.

The present invention also provides a wound fiber package comprising at least one strand comprising at least one fiber, comprising: a conical section of strand having a conical shaped surface; and a plurality of conical shaped successive layers of strand overlaying the conical surface of the conical section, wherein the successive layers form a package having; a generally cylindrical shaped portion; and a conical shaped portion at one end of the cylindrical portion.

The present further provides a wound fiber package comprising at least one strand comprising at least one fiber, comprising: a plurality of overlaying conical shaped strand layers forming a generally cylindrical shaped portion and a conical shaped portion comprising an inclined conical surface at one end of the cylindrical portion.

Another aspect of the present invention is a wound glass fiber package, comprising: a plurality of conical shaped overlaying layers of strand comprising at least one glass fiber, forming a conical shaped portion having an indexing ratio A:B, wherein A is greater than 0.

DETAILED DESCRIPTION OF THE INVENTION

The present invention winds a fiber strand onto a bobbin to form a package in a manner such that upon later use, the strand is not drawn across selected surface portions of the package so as to reduce strand abrasion and breakage.

For the purposes of this application, except where otherwise indicated, all numbers expressing quantities such as weights, dimensions, and so forth herein are to be understood as being modified in all instances by the term "about". Accordingly, unless indicated to the contrary, the numerical parameters are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any example is reported as precisely as possible. Any numerical value, however, inherently contain certain errors necessarily resulting from the standard deviation found in their respective measuring and testing methods.

Figure 1:
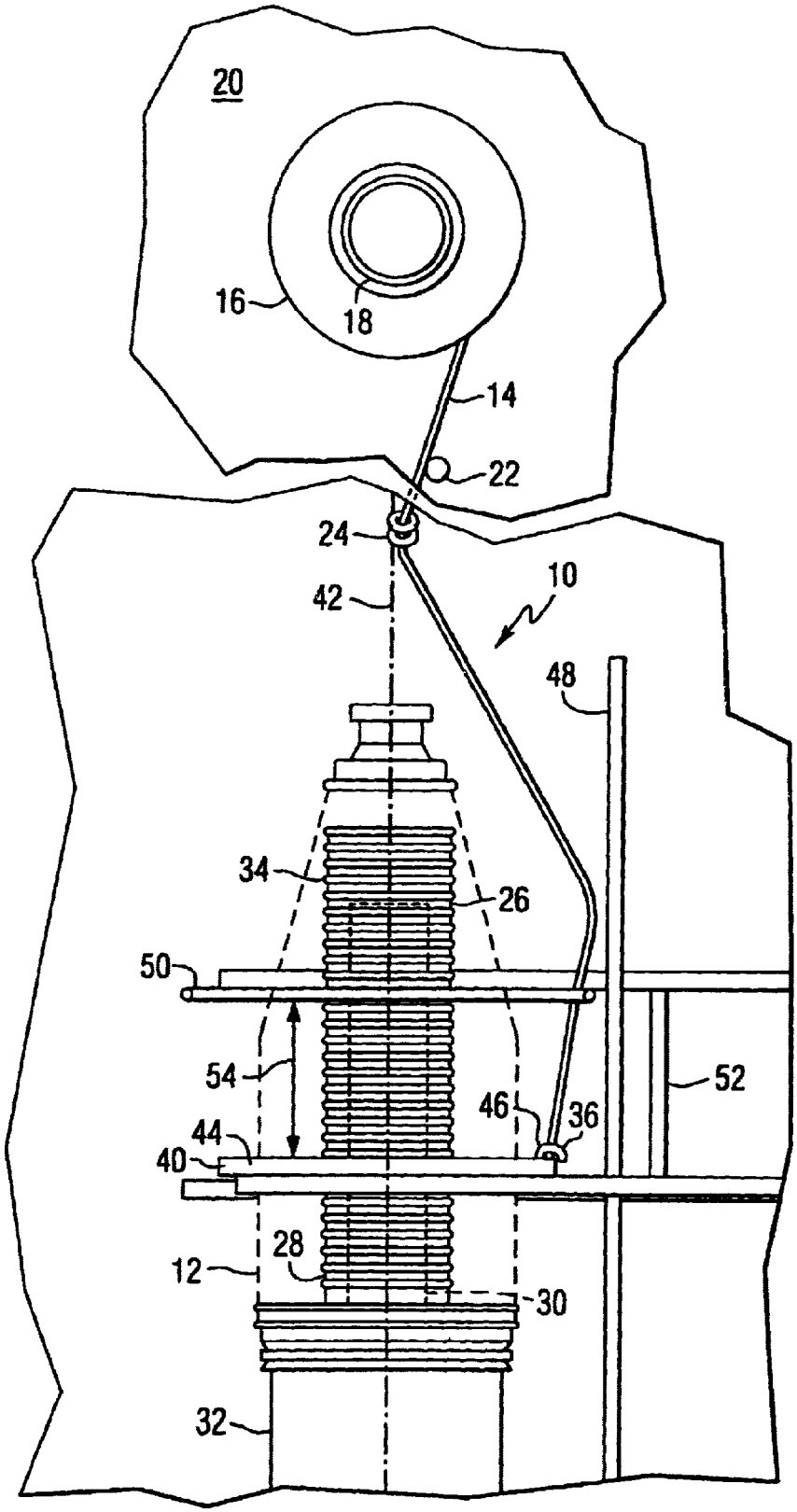
FIG. 1 is a schematic front elevational view of an apparatus for producing a wound package of fiber strand incorporating features of the present invention.

FIG. 1 illustrates an embodiment of a winder, generally designated 10, for winding a wound package 12, in accordance with the present invention.

The wound package 12 is formed from a generally continuous coated fiber strand 14. As used herein, the phrases "fiber strand" or "strand" mean a plurality of individual fibers, i.e., at least two fibers, and the strand can comprise fibers made of different fiberizable materials. The bundle of fibers can also be referred to as "yarn". The term "fiber" means an individual filament. Although not limiting the present invention, the fibers preferably have an average nominal fiber diameter ranging from 3 to 35 micrometers. The present invention is generally useful in the winding of fiber strands, yarns or the like of natural or man-made materials.

Although not limiting in the present invention, the fibers of strand are preferably formed from any type of fiberizable glass composition known to those skilled in the art, including those prepared from fiberizable glass compositions such as "E-glass", "A-glass", "C-glass", "D-glass", "R-glass", "S-glass", and E-glass derivatives. As used herein, "E-glass derivatives" means glass compositions that include minor amounts of fluorine and/or boron and preferably are fluorine-free and/or boron-free. Furthermore, as used herein, "minor amounts of fluorine" means less than 0.5 weight percent fluorine, preferably less than 0.1 weight percent fluorine, and "minor amounts of born" means less than 5 weight percent boron, preferably less than 2 weight percent boron. Basalt and mineral wool fibers are examples of other glass fibers useful in the present invention. Preferred glass fibers are formed from E-glass or E-glass derivatives. Such compositions and methods of making glass filaments therefrom are well known to those skilled in the art and further discussion thereof is not believed to be necessary in view of the present disclosure. If additional information is needed, such glass compositions and fiberization methods are disclosed in K. Loewenstein, *The Manufacturing Technology of Glass Fibres*, (3d Ed. 1993) at pages 30–44, 47–60, 115–122 and 126–135, and U.S. Pat. Nos. 4,542,106 and 5,789,329, which are hereby incorporated by reference.

In addition to glass fibers, the fibers of strand 14 can be formed from other types of fiberizable material known to those skilled in the art including fiberizable inorganic materials, fiberizable organic materials and mixtures of any of the foregoing. The inorganic and organic materials can be either man-made or naturally occurring materials. As used herein, the term "fiberizable" means a material capable of being formed into a generally continuous filament, fiber, strand or yarn.

Non-limiting examples of suitable non-glass fiberizable inorganic materials include ceramic materials such as silicon carbide, carbon, graphite, mullite, aluminum oxide and piezoelectric ceramic materials. Non-limiting examples of suitable fiberizable organic materials include cotton, cellulose, natural rubber, flax, ramie, hemp, sisal and wool. Non-limiting examples of suitable fiberizable organic polymeric materials include those formed from polyamides (such as nylon and aramids), thermoplastic polyesters (such as polyethylene terephthalate and polybutylene terephthalate), acrylics (such as polyacrylonitriles), polyolefins, polyurethanes and vinyl polymers (such as polyvinyl alcohol). Non-glass fiberizable materials useful in the present invention and methods for preparing and processing such fibers are discussed at length in the *Encyclopedia of Polymer Science and Technology*, Vol. 6 (1967) at pages 505–712, which is specifically incorporated by reference herein. It is understood that blends or copolymers of any of the above materials and combinations of fibers formed from any of the above materials can be also used in the present invention, if desired.

The glass fibers can be formed in any suitable method known in the art, for forming glass fibers. For example, glass fibers raw materials can be combined, melted and homogenized in a glass melting furnace, and delivered into fiber forming apparatuses where the molten glass is attenuated into continuous glass fibers by winding groups of fibers on a winder to produce forming packages. For additional information relating to glass compositions and methods of forming the glass fibers, see K. Loewenstein, *The Manufacturing Technology of Continuous Glass Fibres*, (3d Ed. 1993) at pages 30–44, 47–103, and 115–165; U.S. Pat. Nos. 4,542,106 and 5,789,329; and IPC-EG-140 "Specification for Finished Fabric Woven from 'E' Glass for Printed Boards" at page 1, a publication of The Institute for Interconnecting and Packaging Electronic Circuits (June 1997), which are specifically incorporated by reference herein.

Preferably, one or more coating compositions are present on at least a portion of the surfaces of the glass fibers to impart desired features to the fiber, e.g. to protect the fiber surfaces from abrasion during processing and inhibit fiber breakage. Preferably, the coating is present on the entire outer surface or periphery of the fibers. Non-limiting examples of suitable coating compositions include sizing compositions and secondary coating compositions. As used herein, the terms "size", "sized" or "sizing" refer to the coating composition, typically an aqueous composition applied to the filaments immediately after formation of the glass fibers. The term "secondary coating" refers to a coating composition applied secondarily to one or a plurality of strands after the sizing composition is applied, and preferably at least partially dried.

Typical sizing compositions can include as components film-formers, lubricants, coupling agents, emulsifiers, antioxidants, ultraviolet light stabilizers, colorants, antistatic agents and water, to name a few. Examples of suitable sizing compositions are set forth in *Loewenstein* at pages 243–295 (2d Ed. 1983) and U.S. Pat. Nos. 4,390,647 and 4,795,678, each of which is hereby incorporated by reference.

The sizing can be applied in many ways, for example by contacting the filaments immediately after formation with a static or dynamic applicator, such as a roller or belt applicator, spraying, or other means, examples of which are disclosed in *Loewenstein* at pages 169–177, which is hereby incorporated by reference.

The sized fibers are preferably dried at room temperature or at elevated temperatures. Suitable ovens for drying glass fibers are well known to those of ordinary skill in the art. Drying of glass fiber forming packages or cakes is discussed in detail in *Loewenstein* at pages 224–230, which is hereby incorporated by reference. For example, the forming package can be dried in an oven at a temperature of 104° C. (220° F.) to 160° C. (360° F.) for 10 to 13 hours to produce glass fiber strands having a dried residue of the sizing composition thereon. The temperature and time for drying the glass fibers will depend upon such variables as the percentage of solids in the sizing composition, components of the sizing composition and type of glass fiber.

The amount of the sizing composition present on the fiber strand after drying is preferably less than 30 percent by weight, more preferably less than 10 percent by weight and most preferably between 0.1 to 5 percent by weight as measured by loss on ignition (LOI). As used herein, the term "loss on ignition" means the weight percent of dried sizing composition present on the surface of the fiber strand as determined by Equation 1:

$$LOI=100\times[(W_{dry}-W_{bare})/W_{dry}] \quad \text{(Eq. 1)}$$

wherein $W_{dry}$ is the weight of the fiber strand plus the weight of the sizing composition after drying in an oven at 220° F. (104° C.) for 60 minutes and $W_{bare}$ is the weight of the bare fiber strand after heating the fiber strand in an oven at 1150° F. (621° C.) for 20 minutes and cooling to room temperature in a dessicator.

If desired, after drying the sized glass strands can be further treated with a secondary coating composition, that can be the same as or different from the sizing composition, in any convenient manner well known to those skilled in the art.

The present invention will now be discussed generally in the context of its use in the winding of glass fiber strands on a bobbin. However, one of ordinary skill in the art would understand that the present invention is useful in the processing of any of the fibers discussed above. Typical winding techniques are well to those skilled in the art. Without limiting the present invention, one type of winding operation is disclosed in U.S. Pat. No. 5,725,167, which is hereby incorporated by reference.

Referring now to FIG. 1, the strand(s) 14 is supplied to the winder 10 by one or more forming packages 16. Although up to 60 forming packages can be used to feed a winder 10, preferably a single forming package is used. A single forming package 16 is shown in FIG. 1 for purposes of clarity in the drawings.

As shown in FIG. 1, the forming package 16 has at least one fiber or strand 14 wound thereon. In the preferred process, each strand 14 comprises a plurality of generally linear filaments, for example continuous glass filaments.

Typical forming packages 16 are generally cylindrically-shaped and have a hollow center. The strand 14 is drawn from the outside of the forming package 16 for textile yarn manufacturing. The dimensions of the forming package 16 can vary, depending upon such variables as the diameter and type of fiber wound thereon, and are generally determined by convenience for later handling and processing. Generally, forming packages 16 are 15.2 to 76.2 centimeters (6 to 30 inches) in diameter and have a length of 5.1 to 101.6 centimeters (2 to 40 inches). The sides of the forming package 16 can be tapered or rounded. Non-limiting examples of forming package 16 dimensions are set forth in U.S. Pat. Nos. 3,685,764 and 3,998,326, each of which is hereby incorporated by reference.

Referring to FIG. 1, the forming package 16 is supported by a rotatable support 18, preferably by positioning the hollow of the package 16 upon the support 18. The support 18 is attached to a frame 20, which can be a portion of the winder 10 as shown in FIG. 1 or a portion of a separate, free-standing frame such as a creel. The frame 20 can be formed from a rigid material such as stainless steel, carbon steel or aluminum. Conventional creels suitable for use in the present invention are shown in *Loewenstein* at page 322, which is hereby incorporated by reference.

Preferably, the rotatable support 18 is a driven roll which is rotated at a predetermined speed by a drive device (not shown) to unwind the forming package 16. Suitable drive devices including motors are well known to those skilled in the art and further discussion thereof is not believed to be necessary. The support 18 can be rotated at a constant speed or preferably at a varying speed. The speed at which the support 18 is rotated can be 50 to 300 revolutions per minute (rpm), and preferably 100 to 250 rpm. Preferably, the support is rotated at an average constant speed such that the strand 14 is fed to the winder 10 at a generally constant average feed rate of 50 to 300 meters/minute, and more preferably 100 to 250 meters/minute.

The winder 10 can further include a drop wire device 22 or other similar device that ensures that the strand 14 being provided to the winder 10 has not broken. The drop wire device 22 includes a rigid member or wire, a biasing means and a signaling means for signaling an operator (not shown) or the winder 10 to stop the winder 10 when contact between the wire and strand 14 is interrupted, for example when the strand 14 breaks. Other suitable strand interruption devices are well known to those skilled in the art and further discussion thereof is not believed to be necessary.

The winder 10 can further include a strand alignment device. The strand alignment device aligns the strand received from the forming package 16 with a rotatable collector of the winder to facilitate winding. A non-limiting example of a suitable strand alignment device is a coil or pig-tail 24, shown in FIG. 1. The pig-tail 24 is a loose coil of metal or other rigid material through which the strand 14 is threaded. Other devices for aligning the strand 14 with the collector will be evident to those skilled in the art and further discussion thereof is not believed to be necessary.

The fiber strand 14 is wound about a barrel 26 of a bobbin 28 supported upon a rotatable collector or spindle 30 of the winder 10 to form a wound package 12. Preferably, the winder 10 is a strand twisting apparatus 32 or twist frame, shown in FIG. 1, which imparts a twist to the strand 14 during winding to form a yarn. The twist is expressed in units of turns of twist per inch or meter. Although not limiting in the present invention, suitable twist can be 15 to 50 turns per meter. The twist is also specified in terms of direction by a letter. Yarn has an S-twist if, when positioned vertically, the visible spirals or helices around its central axis assume an ascending right to left configuration, as in the central portion of the letter "S". In Z-twist yarn, the strands assume an ascending left to right configuration as in the central portion of the letter "Z". The present process is suitable for forming yarns having either S-twist or Z-twist. The present invention is also suitable for forming yarns that have little or no twist, typically referred to as zero-twist yarn, which is well known to those skilled in the art.

The yarn can be plied by twisting a plurality of strands or cabled by twisting a plurality of plied yarns. For more information regarding the twisting of yarns, see *Loewenstein* at pages 333–339, which is hereby incorporated by reference.

Although not required, bobbin 28 can be any conventional bobbin well known to those skilled in the art. Preferably, barrel 26 of the bobbin 28 is generally cylindrical, although all or a portion of the cylinder can be conical. Barrel 26 of the bobbin 28 can have one or more ridges 34, protrusions or irregularities, as desired. The bobbin can be made from any generally rigid, non-abrasive material, but preferably is made from a thermoplastic material such as high-impact polystyrene. Non-limiting examples of suitable bobbins are shown as #28, #31, #33, #41, #53 and #96 in "PPG Fiber Glass Yarn Products and Packaging", a Technical Bulletin of PPG Industries, Inc. of Pittsburgh, Pa. (March 1994) at pages 3–4, which is hereby incorporated by reference. Other useful bobbins are disclosed in U.S. Des. Pat. Nos. 292,643 and 282,312 and U.S. Pat. Nos. 4,600,165; 4,596,366 and 3,860,194, each of which is hereby incorporated by reference.

In a strand twisting apparatus 32, such as is shown in FIG. 1, the bobbin 28 is supported or releasably mounted upon the rotatable collector or spindle 30, shown in phantom in FIG. 1. The spindle 30 and bobbin 28 are typically rotated at a speed of 2500 to 7500 revolutions per minute (rpm), and preferably 3000 to 7000 rpm. Methods and apparatus for securing the bobbin 28 to the spindle 30, as well as drive arrangements to rotate the bobbin 28 and spindle 30, are well known to those skilled in the art.

A non-limiting listing of twist frame manufacturers includes Baco Machinery, Inc. of Bessmer City, N.C., ICBT of Valence, France and Platt-Saco Lowell of Easley, S.C.

To align and control the deposition of the strand 14 around the barrel 26 of the bobbin 28 and the tightness of the layers of strand 14 deposited upon it, the strand 14 is passed through a traveler 36, or traverse, slidably engaged with a ring 40, which in turn is reciprocated along a central axis of rotation 42 of the bobbin 28 as the strand 14 is wound around the bobbin 28 to form the wound package 12.

The ring 40 has a track 44 that secures the traveler 36 and permits the traveler 36 to circle the ring 40 in response to the forces exerted upon the strand 14 as the package 12 is wound. The tension in the strand 14 is influenced by the weight of the traveler 36. Although not limiting in the present invention, the traveler 36 can weigh 0.1 grams to 0.5 grams, and in textile yarn winding is typically made of nylon.

The traveler 36 has a yarn contact surface 46 which can be varied in size or shape depending upon such factors as the type and weight of the strand 14. Preferably, the traveler 36 is C-shaped, providing a curved yarn contact surface 46. Although not limiting in the present invention, the top to bottom inside dimension of the traveler 36 is 5 to 19 millimeters for receiving an average strand diameter of 0.5 to 1 millimeter.

During winding, the strand 14 between the traveler 36 and pig-tail 24 arcs or balloons out a distance about the package 12, depending upon the tension being exerted on the strand 14. The traveler 36 preferably has sufficient weight to prevent the strand 14 from interfering with other nearby equipment or processes and from contacting any other equipment surfaces, such as the partition 48, shown in FIG. 1, which separates one winding position from another.

The winder 10 can also include a second ring 50 spaced apart from and located above the ring 40 to limit the diameter of the balloon. This second ring 50 is formed from a generally rigid material, such as aluminum. The second ring 50 is generally moved in coordination with the ring 40 as the ring 40 is reciprocated along the axis 42.

The winder 10 can further include a traverse drive (not shown) for reciprocating the ring 40 with the traveler 36 and the second ring 50, if present, along the central axis of rotation 42 of the spindle 30 to deposit the strand 14 upon the barrel 26 of the bobbin 28. Preferably, the ring 40 and second ring 50 are mounted upon a support 52 in a manner that which permits the ring 40 and second ring 50 to maintain a constant distance 54 therebetween during reciprocation. The distance 54 can be 10 to 30 centimeters, and preferably 10 to 20 centimeters, and is determined by such factors as strand mass and feed rate.

The support 52 is connected to a motor (not shown) which reciprocates the support 52, ring 40 and second ring 50 along the axis 42 in response to electrical pulses received from a programmable logic controller, e.g. such as are available from Allen Bradley of Milwaukee, Wis. A non-limiting example of a suitable motor is a 1½ horsepower Indiana General motor. The reciprocal movement of the rings 40 and 50, the movement of the traveler 36 and the rotation of the spindle 30 all contribute to the pattern in which the strand is placed in layers upon the bobbin 28, otherwise known as the "build".

Figure 3:
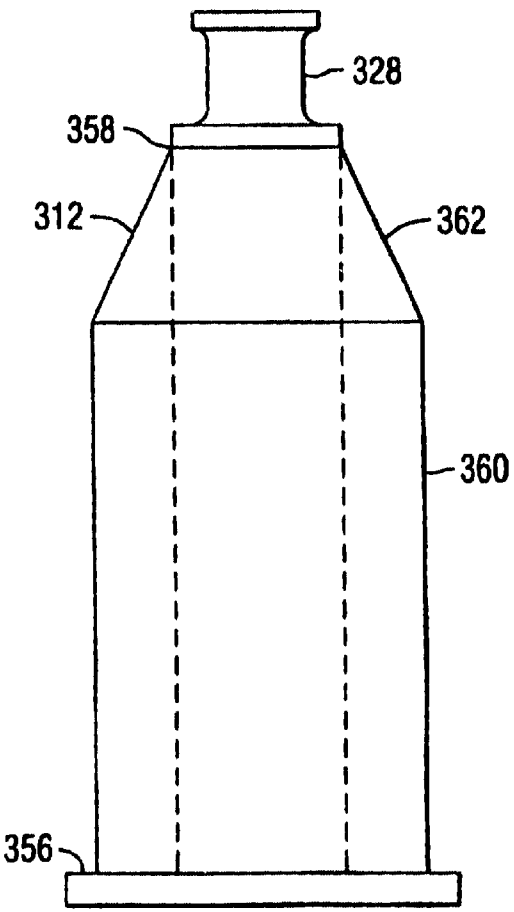
FIG. 3 PRIOR ART
FIGS. 2 and 3 illustrate the shape of package builds typically used in a weaving operation.
Figure 2:
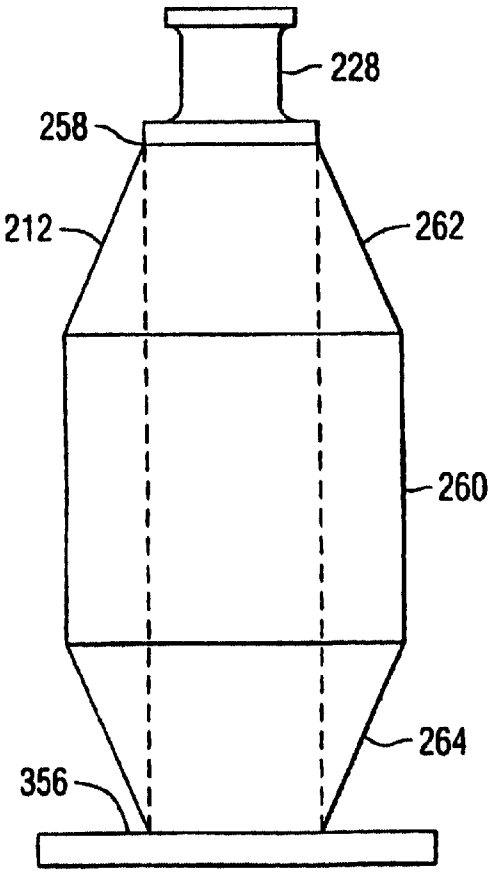
FIG. 2 PRIOR ART

Yarn used as warp strands in a weaving operation is typically wound and built up on a bobbin in configurations as shown in FIGS. 2 and 3. The yarn package 212 illustrated in FIG. 2 is typically referred to as a "pirn" build and the yarn package 312 illustrated in FIG. 3 is typically referred to as a "bottle" build. With continued reference to FIG. 2, package 212 has a central cylindrically shaped section 260, an upper conical section 262 and a lower conical section 264. This package configuration is formed by traversing the twist ring rail of a twist frame (as discussed earlier) over all parts of bobbin 228 in a cycle that is repeated until the bobbin is filled. For example, and without limiting the present invention, a bobbin 228 that includes an 11 inch (27.9 cm) long, 8 pound (3.63 kg) pirn shaped package 212 of D450 glass fiber yarn is formed by a twist frame using a 7.5 inch (19.1 cm) long stroke and incrementally moving the 7.5 inch stroke from the bottom 256 of the bobbin 228 upward along the bobbin until the uppermost limit of the stroke reaches the top 258 of the bobbin. As used herein, the term "stroke" means the movement of the twist frame ring from a first position at one movement limit, along the bobbin, to a second position at the opposite movement limit. The twist frame then incrementally indexes the 7.5 inch stroke downward until the lowermost limit of the stroke reaches the bottom 256 of the bobbin 228. This cycle takes about 20–30 minutes and is repeated until the desired package weight is achieved.

Referring to FIG. 3, package 312 includes an upper conical section 362 and a lower cylindrical section 360. Package 312 is formed by incrementally increasing and decreasing the stroke length during winding. For example and without limiting the present invention, an 11 inch (27.9 cm) long, 10 pound (4.54 kg) bottle shaped package 312 of E225 glass fiber yarn is formed by a twist frame using an initial 7 inch (17.8 cm) stroke length starting from the bottom 356 of the bobbin and incrementally increasing the upper limit of the stroke to increase the total stroke length until the stroke length is 11 inches long and reaches the top 358 of the bobbin 328. The stroke length is then incrementally shortened until it is reduced to its initial 7 inch length. The cycle takes about 20 to 30 minutes and is repeated until the desired package weight is achieved.

With continued reference to FIGS. 2 and 3, due to the above described fiber winding cycles, as yarn pays out from package 212, portions of the yarn being drawn from center portion 260 and lower portion 264 tend to be dragged across the underlying yarn surface. Similarly, portions of yarn drawn from lower section 360 of package 312 tend to drag over the underlying yarn surface. This is particularly apparent when the yarn is the warp yarn in a weaving operation, and is even more apparent when the warp yarn is a fine yarn. As used herein, "fine yarn" means yarn formed from glass fibers or filaments having a diameter of no greater than about 7 micrometer ($2.8\times10^{-4}$) (E filaments and below). More particularly, as the yarn is removed from the wound package on the bobbin, the yarn tends to fly away, or balloon, from the package surface. However the lightweight nature of the fine yarns tends to limit this feature. In addition, if the yarn is coated with a tacky or sticky coating, this will also reduce the ability of the yarn to move away from the surface of the package. The lightweight and/or tacky coating of the yarn results in the yarn being dragged along the package surface during yarn pay-out, and this in turn results in yarn-on-yarn abrasion which causes broken filaments and yarn breakage as the yarn pays out from the yarn package. This condition is particularly apparent for yarn drawn from the lower portions of a yarn package.

To avoid this abrasion and accompanying breakage problem, the present application provides a winding profile that avoid the dragging of yarn over the underlying yarn surface. The present invention also provides a winding sequence that allows additional yarn yardage in the package without exceeding the operating parameters of the twist frame equipment. More particularly, yarn is wound on a bobbin to form a package whose pay-out is always along a conical surface of the package and the yarn pays-out in successive layers along the conical surface, i.e. the yarn is unwound from one layer before proceeding to the next layer, and the yarn is not dragged across the surface of the package. It should be appreciated that during pay-out, as the yarn is removed the conical surface recedes toward the opposite end of the bobbin. To achieve this type of profile, the stroke of the twist frame rail is controlled so that the yarn is wound in successive layers along the conical surface of the package and when the twist frame rail initially reaches the top of the bobbin, the wound package is complete. For example and without limiting the present invention, the particular package configuration shown in FIG. 4 includes a conical shaped package 412 with an inclined upper conical surface 466. This configuration is formed by establishing a short initial rail stroke starting from the bottom 456 of the bobbin 428 and incrementally raising the upper limit for each successive stroke while maintaining the lower limit at the bottom of the bobbin, until the upper limit of the stroke corresponds to the top 458 of the package 412 or winding is terminated for other reasons, as will be discussed later in more detail. It should be appreciated that the lower limit can also be changed, as will be discussed later in more detail. The slope of conical surface 466 (and the slope of a lower inclined conical surface of a package as will be discussed later in more detail) is controlled by the increments by which the upper and lower limits of the stroke are changed. As used herein, the terms "indexing ratio", "indexing ratio A:B" and "A:B ratio" are expressions describing the change in upper and lower limits of each stroke, wherein A is the number of increments the upper limit is raised after each stroke and B is the number of increments the lower limit is raised after each stroke. The conical shaped package 412 is formed by setting B equal to 0 and the slope of upper conical surface 466 is established by the magnitude of A. For the sake of illustration, assume that the entire length of the package 412 is divided into 1000 equal units, with the bottom 456 of the bobbin 428 designated as 0 and the top 458 of the bobbin designated as 1000, the initial stroke length of the winder is 4 units long and the A:B ratio is 2:0. This means that the upper limit will increase 2 units after each stroke while the lower limit will remain the same. In operation, the first stroke starts at 0 at the bottom 456 of bobbin 428 and moves upward to 4. The stroke then reverses and moves downward back to 0, because the lower limit is not indexed upward. The stroke then reverses and moves upward, and since the upper limit is indexed upward 2 units each stroke, it stops at 6 (i.e. 4+2). The stroke then moves downward and stops at 0, then moves upward and reverses when it reaches 8 (i.e. 6+2), etc. It is noted that as the package 412 is formed, each successive stroke is slightly longer than the proceeding stroke. When the upper limit of the stroke in the example reaches 1000 or the desired package weight is achieved, the winding operation is complete. With this type of winding sequence, the yarn is wound onto the bobbin 428 in a series of successive, generally parallel layers 472 along conical surface 466 such that as the yarn is unwound from the package 412, the yarn is removed from an entire layer 472 before proceeding to the next layer and as each layer is removed, the next layer 472 is exposed and subsequently paid out.

It should be appreciated that the twist frame equipment can limit the size of the package described above. More particularly, as the package 412 is built, the diameter 470 at the bottom of the package increases. Twist frame equipment is generally designed to accommodate a package build having a specific diameter. When the diameter of the package 412 reaches the equipment limit, the winding operation would stop because further winding would increase the package diameter 470 beyond the equipment limits. As a result, depending on the capabilities of the twist frame, the desired package weight might not achievable.

As a result, in order to achieve the desired increased package weight while maintaining the unwinding properties discussed above, the winding sequence can be modified to provide a multiple stage winding operation. As used herein, the term "multiple stage" means that the A:B ratio changes at least once during the winding operation. More particularly, in one non-limiting example, a bottle shaped package incorporating the teachings of the present invention can be built by changing the A:B ratio during the winding operation in order to achieve an increased package weight. Referring to FIG. 5, package 512 is formed by initially forming a conical shaped portion 574 (shaded portion of FIG. 5) at the bottom 556 of bobbin 528 in a manner as discussed above with respect to package 412 in FIG. 4, i.e. establishing an initial A:B ratio and setting B equal to 0. When the diameter 570 of the package 512 reaches the desired amount, the A:B ratio is changed to a second A:B ratio such that A equals B. This will build a plurality of conical shaped layers 572 of yarn over the conical surface 575 of portion 574 which in turn forms a cylindrically shaped lower portion of the package while maintaining a conical upper surface. When the build is complete, package 512 will include a lower cylindrical section 560 and an upper conical section 562 with an inclined conical surface 566. If desired, the final A can be the same as or different from the initial A. For the sake of illustration, assume that the entire length of the package is divided into 1000 equal units, the initial stroke of the winder is 4 units long and the initial A:B is 2:0. In operation, a conical shaped package 574 would be initially formed in a manner as discussed above. As the package is built, the conical shaped package 574 with a conical shaped upper surface 575 will be initially formed with upper conical surface 566. When the diameter 570 of the package reaches the desired amount, the A:B ratio is changed to 2:2. This means that both the upper and lower limits of the stroke will be increased 2 units every stroke. For this illustration, assume the desired diameter is reached when the upper limit reaches 500. At this point in the winding operation, the A:B changes, and the stroke moves from 500 down to 2, reverses and goes up to 502, reverses and moves down to 4, reverses and move up to 504, etc. The winding will continue, winding successive conical layers 572 of yarn. Because of the change to the A:B ratio, the diameter of the package 512 does not increase so that the successive layers 572 begin to form a cylindrical section in the package. Winding continues until the upper limit of the stroke reaches the upper end 558 of the bobbin 528 or the desired package weight is achieved. In the above example, when the upper limit of the stroke reaches 1000, the last stroke would start at 500 and end at 1000. The resulting package 512 is a bottle shape with cylindrical section 560 and conical section 562 having conical surface 566. It should be appreciated that with the winding sequence discussed above, as the yarn pays-out from package 512 it is drawn from each successive layer 572 of yarn, exposing the next layer 572, and the yarn is never drawn from below breakline 578, which is formed at the intersection between conical surface 566 and the cylindrical surface of portion 560. In this manner the yarn can be drawn from the package without the yarn being dragged over the other yarn surfaces of the package. It should be further appreciated that as the yarn is paid out, conical surface 566 recedes downward toward the lower end 556 of the bobbin 528 as viewed in FIG. 5 and corresponds to successive layers 572. As a result, breakline 578 also moves downward along the bobbin 528; however, throughout the unwinding operation, the yarn is always drawn from surface 566 and never below the breakline so as to reduce abrasive wear of the yarn.

Figure 6:
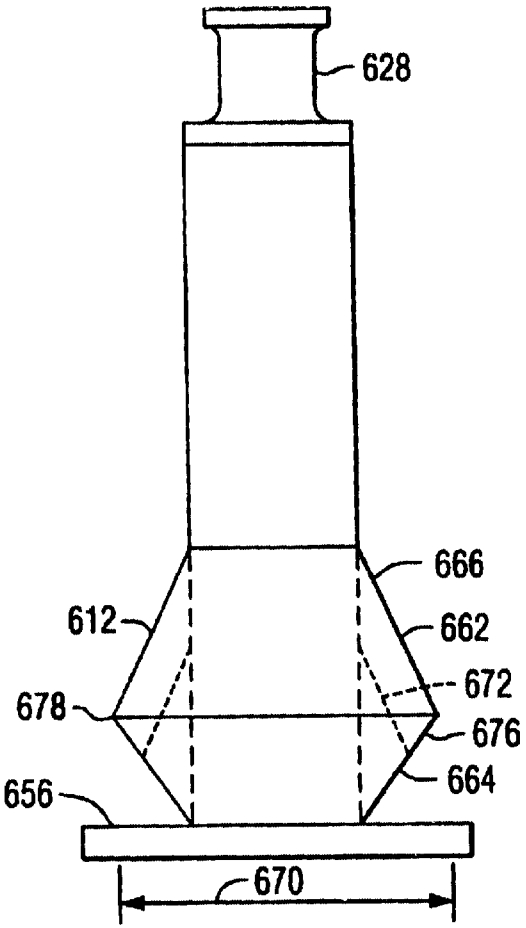

It should be noted that when winding a multiple stage build, more than one change in the ratio can be made. For example and without limiting the present invention, the A:B ratio can change from 2:0 to 2:2 to 2:1. It is anticipated that such sequence would form a compound shape on the yarn surface of the bobbin from which the yarn is drawn. It is further contemplated that the A:B ratio can change continuously throughout a portion or all of the winding operation FIG. 6 illustrates a non-limiting embodiment of the invention wherein glass fiber yarn is not accumulated at the bottom 656 of the bobbin 628. This type of configuration, also referred to as a filling wind, would be useful if there is concern that the yarn along the bottom of the package could get caught and/or entangled along lower flange of the bobbin 628. This build configuration has been used for certain non-glass fiber packages, such as nylon, polyester and cotton fibers. Package 612 includes an upper conical section 662 with an upper conical surface 666 and a lower conical section 664 with a lower conical surface 676. Package 612 is formed such that during pay-out, the yarn is always drawn from the conical surface 666 which recedes toward the lower portion 656 of the bobbin 628 as viewed in FIG. 6. Throughout the pay-out operation, the yarn never falls below breakline 678 so that it is never drawn across lower package surface 676. Breakline 678 is formed at the intersection of conical surface 666 of upper section 662 and conical surface 676 of lower section 664. As discussion earlier, it should be appreciated that the position of breakline 678 will move downward along package 612 during pay-out of the yarn as surface 666 recedes. To achieve this type of profile, the A:B ratio is set such that neither A nor B equal 0. The slopes of the upper and lower conical surfaces 666 and 676 are controlled by the increment by which the upper and lower limits of the stroke are changed. The greater the number, the greater the slope. Furthermore, by raising the upper limit of each stroke a different amount than the lower limit is raised, the slopes of the two surfaces can be different. For the sake of illustrating the winding sequence for package 612, assume that the entire length of the package is divided into 1000 equal units, the initial stroke length of the winder is 4 units long and the indexing ratio A:B of the stroke is 2:1. In operation, the first stroke starts at the bottom 656 of the bobbin 628 at 0 and moves upward to 4. The stroke then reverses and moves downward, but since the lower limit is indexed upward 1 unit each stroke, the stroke stops at 1 (i.e. 0+1). The stroke then reverses and moves upward, and since the upper limit is indexed upward 2 units each stroke, it stops at 6 (i.e. 4+2). The stroke then moves downward and stops at 2 (i.e. 1+1), then moves upward and stops at 8 (i.e. package 612 is formed, each successive stroke length is slightly longer than the proceeding stroke. When the upper limit of the stroke in the example reaches 1000 or the desired weight is reached, the winding operation is complete. In a manner similar to that discussed with respect to packages 412 and 512, package 612 will include successive layers 672 of yarn that are built one over the next along conical surface 666 so that during pay-out, a complete layer of yarn is removed before any yarn from the next layer is removed.

It should be appreciated that in a manner similar to that discussed above regarding package 412, the diameter 670 of package 612 may limit the package size so that the desired package weight might not be attained prior to diameter 670 being too large for the twist frame equipment. However, also as discussed earlier with respect to package 512 and FIG. 5, once the desired package diameter is attained, the A:B ratio can be changed such that a cylindrical section is formed while maintaining the sloped upper surface from which the yarn will be drawn during pay-out. More specifically and referring to the non-limiting example shown in FIG. 7, package 712 is formed by initially forming a section 774 (shaded portion of FIG. 7) having a conical surface 775 at the bottom 756 of bobbin 728, in a manner similar to that discussed earlier for package 612. However, when the desired package diameter 770 is reached, the A:B ratio is changed such that A equals B and the winding continues, winding successive layers 772 of yarn. Because of the change to the A:B ratio, the diameter of the package 712 does not increase so that the successive layers 772 begin to form a cylindrical section between the opposing conical portions of the package. Winding continues until the package 712 reaches the top 758 of the bobbin or the desired package weight is achieved. The resulting package 712 includes a central cylindrical section 760, an upper conical section 762 with an inclined upper conical surface 766 and a lower conical section 764 with a lower inclined conical surface 776. In a manner as discussed earlier, this build configuration incorporates successive layers 772 of yarn such that during the yarn unwinding operation, the yarn is always drawn from each successive yarn layers 772 of the package 712 and is not drawn across the yarn surface of sections 760 and 764 so that yarn-on-yarn abrasive is significantly reduced and preferably eliminated. More particularly, the yarn is never drawn from below the breakline 778 which is formed at the intersection of conical surface 766 and the surface of central section 760. In addition and in a manner as discussed earlier, surface 766 recedes toward the lower end 756 of the bobbin 728 during pay-out, as viewed in FIG. 7 exposing successive layers 772. As a result, breakline 778 also moves downward along the bobbin 728; however, throughout the unwinding operation, the yarn is always drawn from surface 766 and never below the breakline so as to reduce abrasive wear of the yarn.

Figure 7:
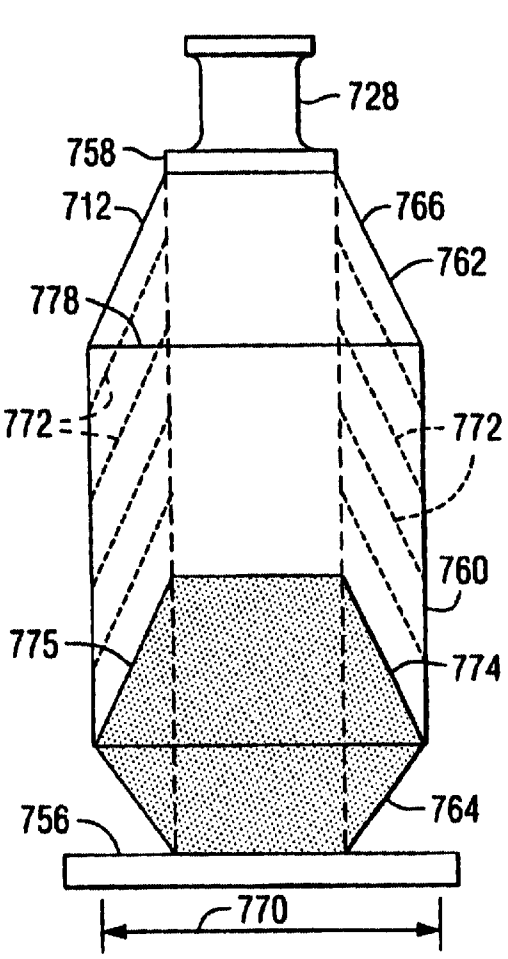

The package shape formed in FIG. 7 can also be formed in another manner that provides some of the advantages of package 712 discussed above. For example, for the sake of illustration as discussed above, assume that the entire length of the package is divided into 1000 equal units, the initial stroke of the winder is 400 units long and the stroke is indexed upward at a ratio of 3:1. In operation, the first stroke would start at 0 and move upward to 400. The stroke would then be reversed and move downward, but since the lower limit is indexed upward 1 unit each stroke, the stroke would stop at 1 (i.e. 0+1). The stroke would then reverse and move upward, and since the upper limit is indexed upward 3 units each stroke, it would stop at 403. The stroke would then move downward and stop at 2, then move upward and stop at 406, etc. With this package build, the final stroke would start at 200 and go up to 1000. Because to lower limit of the stroke is never greater than the upper limit of the initial stroke, a cylindrical center section is built between upper and lower conical sections. This package configuration has some of the same pay-out advantages as discussed above. More specifically, unlike unwinding yarn from a standard pirn build, when unwinding the yarn from the build as discussed above, the yarn is never drawn across the lower inclined surface of the package, thus reducing yarn abrasion and wear. However, because the yarn is layered not only along the inclined upper surface of the package but also the surface of the cylindrical center section, the yarn can be subjected to some dragging across this surface.

Figure 4:
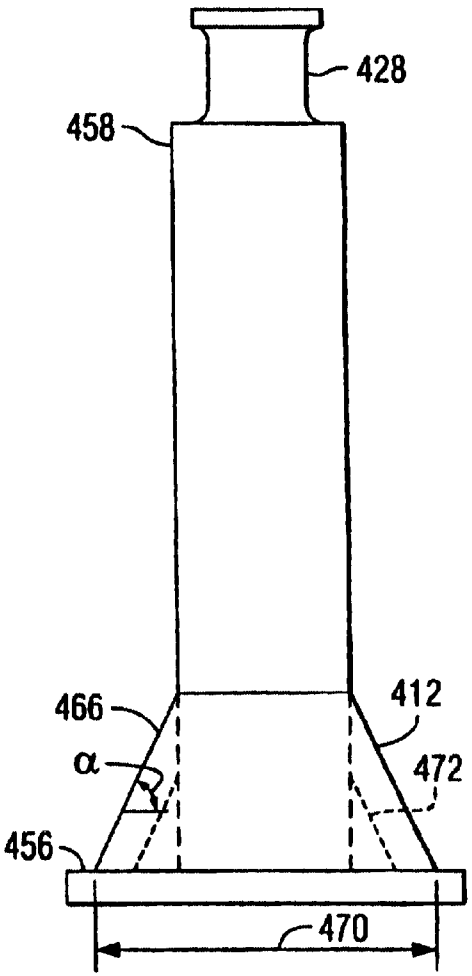
FIGS. 4–7 are package builds incorporating features of the present invention.
Figure 5:
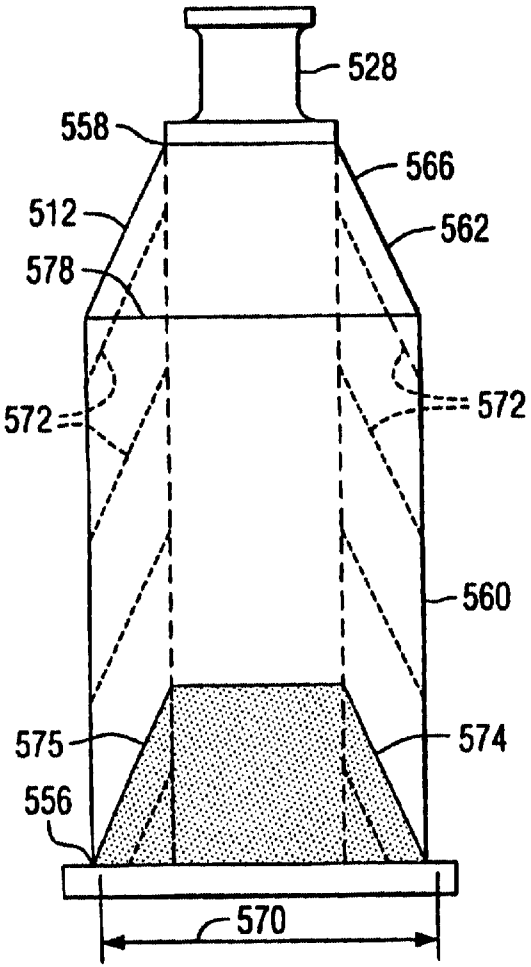

Although not required, it is preferred that the upper slope of any of the packages 412, 512, 612 and 712 of the present invention be at least 45°, measured as shown by angle a in FIG. 4, to ensure that the slope remains stable and the glass fibers do not slip along the surface. Such slippage (also referred to as "sloughing" or "rolling") is highly undesirable in that it creates pay-out problems as well as abrades the underlying glass fibers This is achieved by maintaining an A:B wherein $A \geqq B$ (at 45°, A=B). It should be appreciated that the preferred slope of the packages disclosed herein will depend on several factors, such as but not limited to fiber diameter, the type of fiber, the type of binder on the yarn and yarn tension.

Sizing compositions typically applied to glass fibers to be used in the formation of woven glass fabrics are disclosed in *Loewenstein* at pages 238–244, which are hereby incorporated by reference. However, and without limiting the present invention, the winding as disclosed herein is particularly applicable for yarns comprising glass fibers coated with a coating that is compatible with a resin matrix material into which the yarn is incorporated. As used herein, the terms "compatible with a resin matrix material" or "resin compatible" mean the coating composition applied to the glass fibers is compatible with the resin matrix material into which the glass fibers will be incorporated such that the coating composition (or selected coating components) achieves at least one of the following properties: does not require removal prior to incorporation into the matrix material (such as by de-greasing or de-oiling), facilitates good penetration of the matrix material through the individual bundles of fibers in a mat or fabric incorporating the yarn and good penetration of the matrix material through the mat or fabric during conventional processing and results in final composite products having desired physical properties and hydrolytic stability.

A non-limiting embodiment of a resin compatible coating composition for glass fibers comprises one or more, and preferably a plurality of particles that when applied to the fibers adhere to the fibers and provide one or more interstitial spaces between adjacent glass fibers. Non-limiting examples of preferred particles include hexagonal boron nitride and hollow styrene acrylic polymeric particles.

In addition to the particles, a non-limiting embodiment of the resin compatible coating composition can include one or more film-forming materials, such as organic, inorganic and polymeric materials. Non-limiting examples of film-forming materials include vinyl polymer, such as, but are not limited to, polyvinyl pyrrolidones, polyesters, polyamides, polyurethanes, and combinations thereof.

In addition to or in lieu of the film forming materials discussed above, a non-limiting embodiment of the resin compatible coating compositions can include one or more glass fiber coupling agents such as organo-silane coupling agents, transition metal coupling agents, phosphonate coupling agents, aluminum coupling agents, amino-containing Werner coupling agents and mixtures thereof.

A non-limiting embodiment of the resin compatible coating compositions can further comprise one or more softening agents or surfactants. Non-limiting examples of softening agents include amine salts of fatty acids, alkyl imidazoline derivatives, acid solubilized fatty acid amides, condensates of a fatty acid and polyethylene imine and amide substituted polyethylene imines.

A non-limiting embodiment of the resin compatible coating compositions can further include one or more lubricious materials that are chemically different from the polymeric materials and softening agents discussed above to impart desirable processing characteristics to the fiber strands during weaving. Non-limiting examples of such fatty acid esters useful in the present invention include cetyl palmitate, cetyl myristate, cetyl laurate, octadecyl laurate, octadecyl myristate, octadecyl palmitate and octadecyl stearate. Other useful fatty acid ester, lubricious materials include trimethylolpropane tripelargonate, natural spermaceti and triglyceride oils, such as but not limited to soybean oil, linseed oil, epoxidized soybean oil, and epoxidized linseed oil. The lubricious materials can also include non-polar petroleum waxes and water-soluble polymeric materials, such as but not limited to polyalkylene polyols and polyoxyalkylene polyols.

A non-limiting embodiment of the resin compatible coating compositions can additionally include a resin reactive diluent to further improve lubrication of the coated fiber strands. As used herein, "resin reactive diluent" means that the diluent includes functional groups that are capable of chemically reacting with the same resin with which the coating composition is compatible. The diluent can be any lubricant with one or more functional groups that react with a resin system, preferably functional groups that react with an epoxy resin system. Non-limiting examples of suitable lubricants include lubricants with amine groups (e.g. a modified polyethylene amine), alcohol groups (e.g. polyethylene glycol), anhydride groups, acid groups (e.g. fatty acids)or epoxy groups (e.g. epoxidized soybean oil and epoxidized linseed oil).

A non-limiting embodiment of the resin compatible coating compositions can additionally include one or more emulsifying agents for emulsifying or dispersing components of the coating compositions, such as the particles and/or lubricious materials. Non-limiting examples of suitable emulsifying agents or surfactants include polyoxyalkylene block copolymers, ethoxylated alkyl phenols, polyoxyethylene octylphenyl glycol ethers, ethylene oxide derivatives of sorbitol esters, polyoxyethylated vegetable oils, ethoxylated alkylphenols, and nonylphenol surfactants.

Other additives can be included in a non-limiting embodiment of the resin compatible coating compositions, such as crosslinking materials, plasticizers, silicones, fungicides, bactericides and anti-foaming materials. Organic and/or inorganic acids or bases in an amount sufficient to provide the coating composition with a pH of 2 to 10 can also be included in the resin compatible coating composition.

Non-limiting examples of resin compatible coatings are shown in Table 1.

TABLE 1

WEIGHT PERCENT OF COMPONENT ON TOTAL SOLIDS BASIS

| | Examples | | | | | | | |
|---|---|---|---|---|---|---|---|---|
| COMPONENT | A | B | C | D | E | F | G | H |
| PVP K-30[1] | 13.7 | 13.4 | 13.5 | 13.4 | | | 15.3 | 14.2 |
| STEPANTEX 653[2] | 27.9 | 27.3 | | | | | 13.6 | 12.6 |
| A-187[3] | 1.7 | 1.6 | 1.9 | 1.9 | 2.8 | 2.3 | 1.9 | 1.7 |
| A-174[4] | 3.4 | 3.3 | 3.8 | 3.8 | 4.8 | 4.8 | 3.8 | 3.5 |
| EMERY 6717[5] | 2.3 | 2.2 | 1.9 | 1.9 | | | 2.5 | 2.4 |
| MACOL OP-10[6] | 1.5 | 1.5 | | | | | 1.7 | 1.6 |
| TMAZ-81[7] | 3.0 | 3.0 | | | | | 3.4 | 3.1 |
| MAZU DF-136[8] | 0.2 | 0.2 | | | | | 0.3 | 0.2 |
| ROPAQUE OP-96[9] | 39.3 | 38.6 | | | | | 43.9 | 40.7 |
| RELEASECOAT-CONC 25[10] | 4.2 | 6.3 | 6.4 | 3.8 | | | | 4.5 |
| POLARTHERM PT 160[11] | 2.7 | 2.6 | 2.6 | 5.9 | | | | 2.8 |
| SAG 10[12] | | | 0.2 | 0.2 | | | | |
| RD-847A[13] | | | 23.2 | 23.0 | | | | |
| DESMOPHEN 2000[14] | | | 31.2 | 31.0 | 44.4 | 44.1 | | |
| PLURONIC F-108[15] | | | 8.5 | 8.4 | | 10.9 | | |
| ALKAMULS EL-719[16] | | | 3.4 | 2.5 | | | | |
| ICONOL NP-6[17] | | | 3.4 | 4.2 | | 3.6 | | |
| POLYOX WSR 301[18] | | | | | 0.6 | 0.6 | | |
| DYNAKOLL Si 100[19] | | | | | 29.1 | 28.9 | | |
| SERMUL EN 668[20] | | | | | 2.9 | | | |
| SYNPERONIC F-108[21] | | | | | 10.9 | | | |
| EUREDUR 140[22] | | | | | 4.9 | | | |
| VERSAMID 140[23] | | | | | | 4.8 | | |
| FLEXOL EPO[24] | | | | | | | 13.6 | 12.6 |

[1]PVP K-30 polyvinyl pyrrolidone which is commercially available from ISP Chemicals of Wayne, New Jersey.
[2]STEPANTEX 653 which is commercially available from Stepan Company of Maywood, New Jersey.
[3]A-187 gamma-glycidoxypropyltrimethoxysilane which is commercially available from CK Witco Corporation of Tarrytown, New York.
[4]A-174 gamma-methacryloxypropyltrimethoxysilane which is commercially available from CK Witco Corporation of Tarrytown, New York.
[5]EMERY ® 6717 partially amidated polyethylene imine which is commercially available from Cognis Corporation of Cincinnati, Ohio.
[6]MACOL OP-10 ethoxylated alkylphenol; this material is similar to MACOL OP-10 SP except that OP-10 SP receives a post treatment to remove the catalyst; MACOL OP-10 is no longer commercially available.
[7]TMAZ-81 ethylene oxide derivative of a sorbitol ester which is commercially available from BASF Corp. of Parsippany, New Jersey.
[8]MAZU DF-136 antifoaming agent which is commercially available from BASF Corp. of Parsippany, New Jersey.
[9]ROPAQUE ® OP-96, 0.55 micron particle dispersion which is commercially available from Rohm and Haas Company of Philadelphia, Pennsylvania.
[10]ORPAC BORON NITRIDE RELEASECOAT-CONC 25 boron nitride dispersion which is commercially available from ZYP Coatings, Inc. of Oak Ridge, Tennessee.
[11]POLARTHERM ® PT 160 boron nitride powder which is commercially available from Advanced Ceramics Corporation of Lakewood, Ohio.
[12]SAG 10 antiforming material, which is commercially available from CK Witco Corporation of Greenwich, Connecticut.
[13]RD-847A polyester resin which is commercially available from Borden Chemicals of Columbus, Ohio.
[14]DESMOPHEN 2000 polyethylene adipate diol which is commercially available from Bayer Corp. of Pittsburgh, Pennsylvania.
[15]PLURONIC ™ F-108 polyoxypropylene-polyoxyethylene copolymer which is commercially available from BASF Corporation of Parsippany, New Jersey.
[16]ALKAMULS EL-719 polyoxyethylated vegetable oil which is commercially available from Rhone-Poulenc.
[17]ICONOL NP-6 alkoxylated nonyl phenol which is commercially available from BASF Corporation of Parsippany, New Jersey.
[18]POLYOX WSR 301 poly(ethylene oxide) which is commercially available from Union Carbide Corp. of Danbury, Connecticut.
[19]DYNAKOLL Si 100 rosin which is commercially available from Eka Chemicals AB, Sweden.
[20]SERMUL EN 668 ethoxylated nonylphenol which is commercially available from CON BEA, Benelux.
[21]SYNPERONIC F-108 polyoxypropylene-polyoxyethylene copolymer; it is the European counterpart to PLURONIC F-108.
[22]EUREDUR 140 is a polyamide resin, which is commercially available from Ciba Geigy, Belgium.
[23]VERSAMID 140 polyamide resin which is commercially available from Cognis Corp. of Cincinnati, Ohio.
[24]FLEXOL EPO epoxidized soybean oil commercially available from Union Carbide of Danbury, Connecticut.

Additional non-limiting examples of glass fiber yarns having a resin compatible coating are disclosed in U.S. Ser. No. 09/620,526 entitled "Impregnating Glass Fiber Strands and Products Including the Same" and filed Jul. 20, 2000, which is hereby incorporated by reference.

The following is a non-limiting illustrative example of a multiple stage wound package incorporating features of the present invention. In this example, E225 yarn was formed into a bottle shaped build as shown in FIG. 5. The package was 11 inches (27.9 cm) long and divided into 12690 increments each approximately 0.0008668 inch (22 micrometers) long. The initial stroke was 600 increments (approximately 0.5 inches (1.27 cm)) and the initial indexing ratio A:B was 4:0. It was determined that the desired diameter of the package was 6 inches (15.2 cm) and this diameter would be reached when the upper limit of the winding stroke is approximately at increment 5768. Starting from the bottom of the bobbin which was set at 0, the upper limit of the stroke was increased by 4 increments each stroke, and winding continued until the upper limit reached increment 5768. At this point in the winding operation, the A:B ratio was changed to 4:4 and winding continued until the upper limit of the stroke reached 12690. The resulting package was an 11 inch long, 10 pound package having a 6 inch diameter.

From the foregoing description, it can be seen that the present invention provides a winding operation that reduces the abrasive wear on the yarn and accompanying breaks during pay-out and increases the amount of yarn that can be wound on a bobbin while maintaining these improves pay-out properties. It will be appreciated by those skilled in the art that changes could be made to the embodiments described above without departing from the broad inventive concept thereof. It is understood, therefore, that this invention is not limited to the particular embodiments disclosed, but it is intended to cover modifications which are within the spirit and scope of the invention, as defined by the appended claims.

We claim:

1. A method of forming a wound fiber package, comprising:

winding a first portion of strand comprising at least one fiber on a bobbin using a first indexing ratio A:B, wherein A is greater than 0 and A is greater than B; and winding a second portion of strand comprising at least one fiber on the bobbin using a second indexing ratio A:B different from the first indexing ratio, wherein A and B are greater than 0.

2. The method according to claim 1, wherein A in the first indexing ratio equals A in the second indexing ratio.

3. The method according to claim 1, wherein A in the first indexing ratio is different from A in the second indexing ratio.

4. The method according to claim 1, wherein A equals B in the second indexing ratio.

5. The method according to claim 1, wherein in the first indexing ratio, B equals 0.

6. The method according to claim 5, wherein A in the first indexing ratio equals A in the second indexing ratio.

7. The method according to claim 6, wherein A equals B in the second indexing ratio.

8. The method according to claim 1, wherein in the first indexing ratio, B is greater than 0.

9. The method according to claim 8, wherein A in the first indexing ratio equals A in the second indexing ratio.

10. The method according to claim 9, wherein A equals B in the second indexing ratio.

11. The method according to claim 1, further comprising winding a third portion of strand comprising at least one fiber on the bobbin using a third indexing ratio A:B different from at least one of the first and second indexing ratios.

12. The method according to claim 1, wherein the first and second indexing ratios form a package comprising a cylindrical portion and a conical shaped portion having an inclined conical surface at one end of the cylindrical portion.

13. The method according to claim 12, wherein the inclined conical surface of the conical shaped portion of the package has a slope of at least 45°.

14. The method according to claim 1, wherein the first and second indexing ratios form a package comprising a cylindrical portion, a first conical shaped portion having an inclined conical surface at one end of the cylindrical portion and a second conical shaped portion having an inclined conical surface at an opposing end of the cylindrical portion.

15. The method according to claim 1, both of the winding steps comprise winding a strand comprising at least one glass fiber.

16. The method according to claim 15, wherein the at least one glass fiber is at least partially coated with a resin compatible coating.

17. A method of forming a wound glass fiber package, comprising:

winding a strand comprising at least one glass fiber on a bobbin using an indexing ratio A:B, wherein B is greater than 0 and A is greater than B, so as to form a wound package comprising two adjacent, oppositely oriented conical shaped portions.

18. The method according to claim 17, further comprising coating at least a portion of the at least one glass fiber with a resin compatible coating.

19. A wound glass fiber package, comprising: a plurality of conical shaped overlaying layers of strand comprising at least one glass fiber forming two adjacent, oppositely oriented conical shaped portions having an indexing ratio A:B, wherein B is greater than 0 and A is greater than B.

20. The fiber package according to claim 19, wherein the at least one glass fiber is at least partially coated with a resin compatible coating.

21. A wound fiber package, comprising:

a first portion of strand comprising at least one fiber on a bobbin having a first indexing ratio A:B, wherein A is greater than 0 and A is greater than B; and a second portion of strand comprising at least one fiber on the bobbin having a second indexing ratio A:B different from the first indexing ratio, wherein A and B are greater than 0.

22. The fiber package according to claim 21, wherein A in the first indexing ratio equals A in the second indexing ratio.

23. The fiber package according to claim 21, wherein A in the first indexing ratio is different from A in the second indexing ratio.

24. The fiber package according to claim 21, wherein A equals B in the second indexing ratio.

25. The fiber package according to claim 21, wherein in the first indexing ratio, B equals 0.

26. The fiber package according to claim 25, wherein A in the first indexing ratio equals A in the second indexing ratio.

27. The fiber package according to claim 26, wherein A equals B in the second indexing ratio.

28. The fiber package according to claim 21, wherein in the first indexing ratio, B is greater than 0.

29. The fiber package according to claim 28, wherein A in the first indexing ratio equals A in the second indexing ratio.

30. The fiber package according to claim 29, wherein A equals B in the second indexing ratio.

31. The fiber package according to claim 21, wherein the strand comprises at least one glass fiber.

32. The fiber package according to claim 31, wherein the at least one glass fiber is at least partially coated with a resin compatible coating.

33. The fiber package according to claim 21, wherein the first and second indexing ratios form a package comprising a cylindrical portion and a conical shaped portion having an inclined conical surface at one end of the cylindrical portion.

34. The fiber package according to claim 33, wherein the inclined conical surface has a slope of at least 45°.

35. The fiber package according to claim 33, further comprising an additional conical shaped portion at an opposing end of the cylindrical portion.

36. The fiber package according to claim 21, further comprising a third portion of strand comprising at least one fiber on the bobbin having a third indexing ratio A:B different from at least one of the first and second indexing ratios.

* * * * *